US010795391B2

(12) United States Patent
Shankar et al.

(10) Patent No.: US 10,795,391 B2
(45) Date of Patent: Oct. 6, 2020

(54) VOLTAGE REGULATOR WAKE-UP

(71) Applicant: Texas Instruments Incorporated, Dallas, TX (US)

(72) Inventors: Ruchi Shankar, Karnataka (IN); Somshubhra Paul, Karnataka (IN); Gaurang Helekar, Karnataka (IN)

(73) Assignee: Texas Instruments Incorporated, Dallas, TX (US)

( * ) Notice: Subject to any disclaimer, the term of this patent is extended or adjusted under 35 U.S.C. 154(b) by 598 days.

(21) Appl. No.: 14/845,579

(22) Filed: Sep. 4, 2015

(65) Prior Publication Data

US 2017/0068263 A1 Mar. 9, 2017

(51) Int. Cl.

*G05F 1/56* (2006.01)
*G05F 1/565* (2006.01)
*G05F 1/575* (2006.01)

(52) U.S. Cl.

CPC ..... *G05F 1/575* (2013.01); *G05F 1/565* (2013.01)

(58) Field of Classification Search

CPC . G05F 1/56; G05F 1/562; G05F 1/563; G05F 1/565; G05F 1/569; G05F 1/571; G05F 1/573; G05F 1/575
USPC ..... 323/268–282
See application file for complete search history.

(56) References Cited

U.S. PATENT DOCUMENTS 5,994,885 A * 11/1999 Wilcox ..... H02M 3/156 323/283
6,437,638 B1 * 8/2002 Coles ..... G05F 1/618 327/540
7,266,709 B2 * 9/2007 Chapuis ..... G06F 1/189 713/300
7,836,322 B2 * 11/2010 Chapuis ..... G06F 1/26 323/282
2007/0145830 A1 * 6/2007 Lee ..... H02J 5/005 307/135
2009/0039845 A1 * 2/2009 Gerber ..... G05F 1/56 323/273
2015/0061628 A1 * 3/2015 Nguyen ..... H02M 3/1563 323/282
2015/0137780 A1 * 5/2015 Lerner ..... G05F 1/565 323/280

* cited by examiner

*Primary Examiner* — Thienvu V Tran
*Assistant Examiner* — Nusrat Quddus
(74) *Attorney, Agent, or Firm* — Charles A. Brill; Frank D. Cimino

(57) ABSTRACT

A system includes a voltage regulator having an output voltage; a power management system, coupled to the voltage regulator, operable to continuously monitor the output voltage to determine whether the output voltage is within a range; and the power management system is operable to set the range to a normal range during normal operation, and is operable to increase the range beyond the normal range during a low power mode and during a wake-up period from a low power mode.

22 Claims, 2 Drawing Sheets

VOLTAGE REGULATOR WAKE-UP

BACKGROUND

Many electronic systems include a voltage regulator. For example, battery powered devices often include a DC-DC voltage regulator to provide power at a different voltage than provided by the battery. In general, voltage regulators may be switching or linear. Advantages of linear regulators include low noise (no switching noise) and small size (no large inductors or transformers). One particular linear voltage regulator design is the Low-Drop-Out (LDO) regulator. One advantage of LDO regulators is that the minimum input/output differential voltage at which the regulator can no longer regulate (drop out voltage) is low, hence the name Low-Drop-Out. Another advantage of LDO regulators is a rapid response to a load change.

Many systems, particularly battery powered systems, are switched to a very-low-power sleep mode during periods of inactivity. When the system "wakes up" (comes out of sleep mode), the power supply sees an instantaneous change in load current from essentially zero load current to a large load current. Even though LDO regulators have a relatively fast response to a load change compared to other regulator designs, there is still a finite response time (called wake-up time) during which the output voltage and current may ring around their steady-state values over a finite settling time. In some LDO regulators, additional current (boost current) is supplied by a separate parallel path during wake-up time to reduce the response time. Switching in the boost current can cause voltage glitches and can increase the peak magnitude of output voltage ringing.

Some systems monitor power supply voltages and reset the system when a power supply voltage exceeds a certain range. Voltage ringing during wake-up and voltage glitches from boost current can cause a spurious system reset. A system reset can be catastrophic, for example, in a mission-critical computer system. Accordingly, to avoid spurious system resets, in some systems the voltage reset range is permanently fixed at a wide range such that expected worst case transients do not cause a reset. Alternatively, in some systems voltage monitoring is completely suspended during the entire wake-up period.

DETAILED DESCRIPTION

In the following discussion, a system is described having continuous monitoring of voltage regulator output but with variable power management thresholds for system reset. Relaxed thresholds are used during low power and wake-up when there may be glitches and ringing, and more stringent thresholds are used during normal operation.

Figure 1:
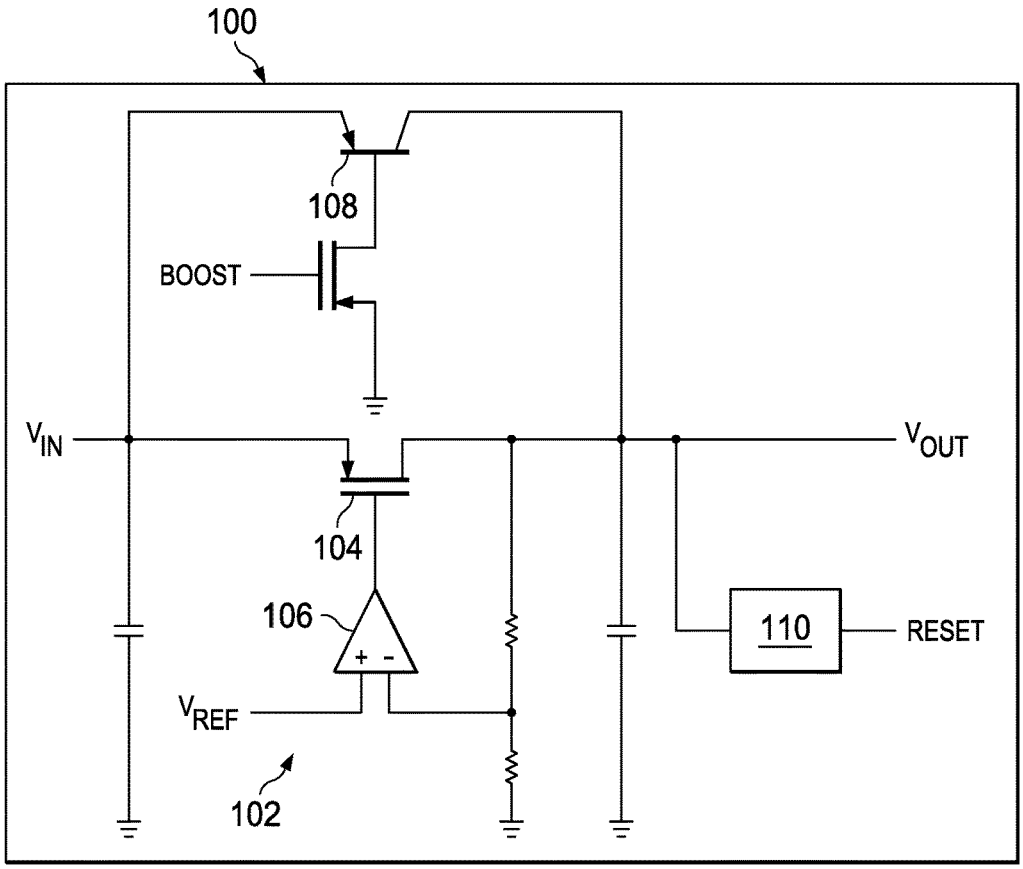
FIG. 1 is a block diagram schematic of an example embodiment of a system.

FIG. 1 shows part of a system 100 including an example voltage regulator 102. The example is simplified to facilitate discussion and illustration. In the example of FIG. 1, the voltage regulator 102 is a linear LDO regulator. The voltage regulator 102 includes a series transistor 104 (a power FET in the example of FIG. 1) driven by a feedback amplifier

106. The feedback amplifier 106 regulates the output voltage $V_{OUT}$ to equal a reference voltage $V_{REF}$. In addition (optionally), a transistor 108 is enabled by a BOOST signal to provide additional current (boost current) at the output of the voltage regulator 102 when there is a need to rapidly transition from a low load current to a high load current during wake-up.

The system 100 also shows a power management system 110. The power management system 110 generates a RESET signal to reset the system 100 when the output voltage $V_{OUT}$ is outside a specified range (above a high threshold or below a low threshold). The power management system 110 may also generate the BOOST signal.

Figure 2:
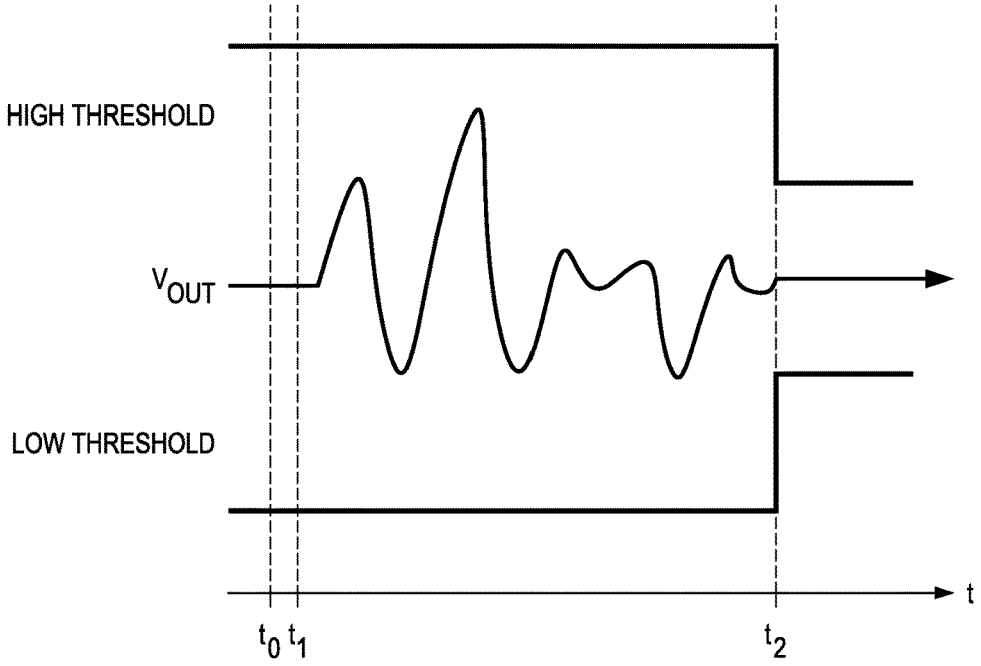
FIG. 2 is a timing diagram illustrating voltage output from a voltage regulator in the system of FIG. 1.

FIG. 2 is an example timing diagram for the system 100. At time $t_0$, the system 100 and the voltage regulator 102 are in a low-power sleep mode, the boost current transistor 108 is off, and the range between the LOW THRESHOLD and the HIGH THRESHOLD is set by the power management system 110 to set to be relatively high. At time $t_1$, the system 100 wakes up, and the voltage regulator 102 switches to a high power mode. If there is a boost current transistor 108, then at time $t_1$ the boost current transistor 108 is turned ON. During low power mode (before $t_0$), and during wake-up, the range between LOW THRESHOLD and HIGH THRESHOLD is set to be sufficiently high so that worst case ringing of $V_{OUT}$ will not trigger a system reset. At time $t_2$, the transient ringing of the output voltage $V_{OUT}$ has settled substantially and the range between the LOW THRESHOLD and HIGH THRESHOLD is set by the power management system 110 to be relatively low. If there is a boost current transistor 108 then the boost current transistor 108 is turned OFF at time $t_2$. The time period between $t_1$ and $t_2$ may be a predetermined fixed time based on expected worst case settling times.

In some prior art systems, the LOW THRESHOLD and HIGH THRESHOLD are fixed at levels to accommodate worst case $V_{OUT}$ transients and ringing, such as the levels shown between $t_1$ and $t_2$ in FIG. 2. Fixed thresholds reduce protection during normal operation after wake-up. In some prior art systems, power management is turned off during wake-up, which results in no protection during wake-up against harmful $V_{OUT}$ transients. In addition, if there is a period of no protection, there is an opportunity for possible system tampering or attack. The system illustrated in FIGS. 1 and 2 is more robust, providing continuous power management (to protect against harmful transients during wake-up and to protect against tampering or attack), with relaxed thresholds during low power and wake-up (to avoid spurious resets), and more stringent thresholds during normal operation (to provide improved protection during normal operation).

Figure 3:
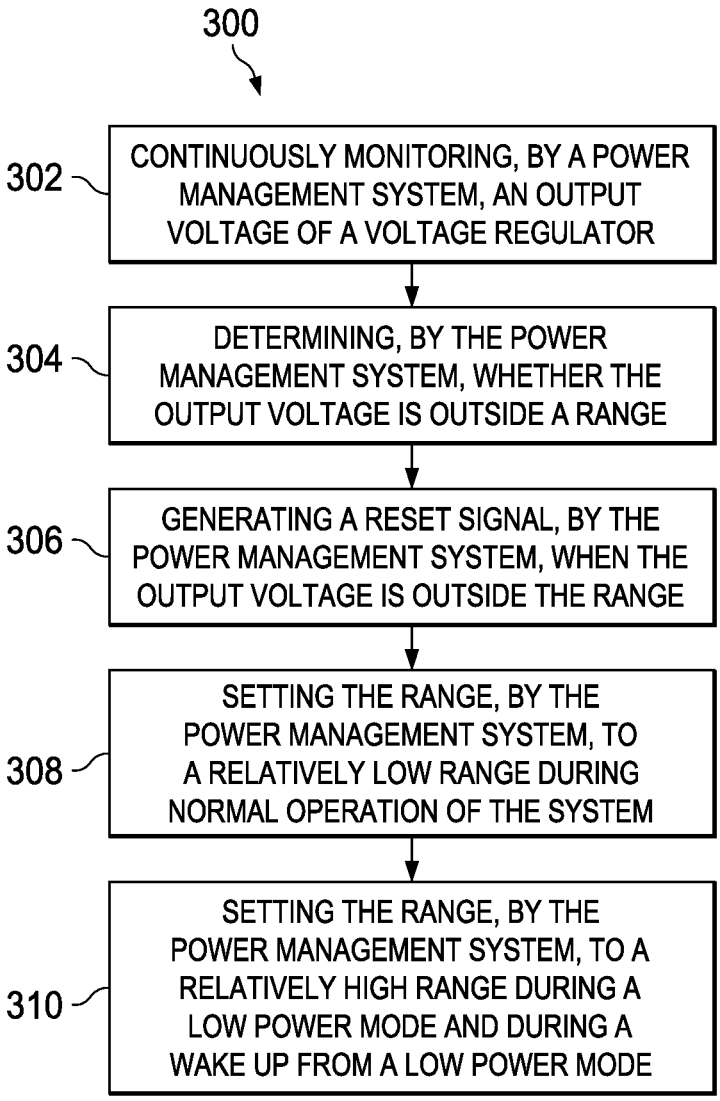
FIG. 3 is a flow chart for a method of managing power to a system.

FIG. 3 is a flow chart for a method 300 of managing power to a system. At step 302, a power management system continuously monitors an output voltage of a voltage regulator. At step 304, the power management system determines whether the output voltage is outside a range. At step 306, the power management system generates a reset signal when the output voltage is outside the range. At step 308, the power management system sets the range to a relatively low range during normal operation of the system. At step 310, the power management system sets the range to a relatively high range during a low power mode and during a wake-up from a low power mode,

What is claimed is:

1. A system, comprising:

a voltage regulator having an output voltage;

a power management system, coupled to the voltage regulator, operable to monitor the output voltage and generate a reset signal when the output voltage is outside a range, the range extending from a first low threshold voltage to a first high threshold voltage during a normal operation period, and from a second low threshold voltage to a second high threshold voltage during a wake-up period.

2. The system of claim 1, further comprising:

a current source, coupled to an output of the voltage regulator, that is operable to provide boost current.

3. The system of claim 2, wherein the power management system enables the current source.

4. The system of claim 1, further comprising:

a current source, coupled to an output of the voltage regulator, that is operable to provide boost current during the wake-up period.

5. The system of claim 4, wherein the power management system enables the current source.

6. The system of claim 1, where the voltage regulator is a linear voltage regulator.

7. The system of claim 6, where the linear voltage regulator is low drop-out voltage regulator.

8. The system of claim 1, wherein the range extending from the first low threshold voltage to the first high threshold voltage is less than the range extending from the second low voltage to the second high threshold voltage.

9. The system of claim 1, wherein the first low threshold voltage is greater than the second low voltage.

10. The system of claim 1, wherein the first high threshold voltage is less than the second high voltage.

11. The system of claim 1, wherein the first low threshold voltage is greater than the second low voltage and the first high threshold voltage is less than the second high voltage.

12. A system, comprising:

a voltage regulator having an output voltage;

a power management system, coupled to the voltage regulator, operable to monitor the output voltage and generate a processor reset signal when the output voltage is outside a range, the range extending from a first low threshold voltage to a first high threshold voltage during a normal operation period, and from a second low threshold voltage to a second high threshold voltage during a wake-up period.

13. The system of claim 12, further comprising:

a current source, coupled to an output of the voltage regulator, that is operable to provide boost current.

14. The system of claim 13, wherein the power management system enables the current source.

15. The system of claim 12, further comprising:

a current source, coupled to an output of the voltage regulator, that is operable to provide boost current during the wake-up period.

16. The system of claim 15, wherein the power management system enables the current source.

17. The system of claim 12, where the voltage regulator is a linear voltage regulator.

18. The system of claim 17, where the linear voltage regulator is low drop-out voltage regulator.

19. The system of claim 12, wherein the range extending from the first low threshold voltage to the first high threshold voltage is less than the range extending from the second low voltage to the second high threshold voltage.

20. The system of claim 12, wherein the first low threshold voltage is greater than the second low voltage.

21. The system of claim 12, wherein the first high threshold voltage is less than the second high voltage.

22. The system of claim 12, wherein the first low threshold voltage is greater than the second low voltage and the first high threshold voltage is less than the second high voltage.

* * * * *